US005381681A

United States Patent [19]

Frisch et al.

[11] Patent Number: 5,381,681

[45] Date of Patent: Jan. 17, 1995

[54] MACHINE WITH AN ADJUSTING DEVICE LOCATED IN A MOVABLE MACHINE PART

[75] Inventors: Helmuth Frisch, Schönberg; Norbert Geissler, Pöcking; Herbert Weiss, Oberhaching, all of Germany

[73] Assignees: O & K Geissler GmbH, Gauting; S & S Electronic GmbH & Co. KG, Schonberg, both of Germany

[21] Appl. No.: 144,730

[22] Filed: Oct. 28, 1993

Related U.S. Application Data

[63] Continuation of Ser. No. 741,544, Aug. 7, 1991, abandoned.

[30] Foreign Application Priority Data

Aug. 7, 1990 [DE] Germany ..... 9011492[U]

[51] Int. Cl.[6] ..... B21D 28/02

[52] U.S. Cl. ..... 72/9; 72/10; 72/12; 72/323; 72/327; 72/450; 83/73; 83/74; 83/530

[58] Field of Search ..... 83/73, 74, 359, 635, 83/917; 72/12, 10, 446

[56] References Cited

U.S. PATENT DOCUMENTS

| | | | |
|---|---|---|---|
| 3,685,341 | 8/1972 | Karsnak | 72/450 |
| 3,948,077 | 4/1976 | Bothe | 72/450 |
| 4,110,895 | 9/1978 | Mitsui | 72/327 |
| 4,167,127 | 9/1979 | Calvert | 74/416 |
| 4,531,391 | 7/1985 | Engman | 72/10 |
| 4,621,512 | 11/1986 | Tachikawa et al. | 72/327 |
| 4,967,586 | 11/1990 | Hecht | 72/450 |
| 5,275,032 | 1/1994 | Gloe et al. | 72/19 |
| 5,285,688 | 2/1994 | Tokai | 72/10 |
| 5,285,722 | 2/1994 | Schockman | 72/446 |

FOREIGN PATENT DOCUMENTS

| | | | |
|---|---|---|---|
| 0367035 | 5/1990 | European Pat. Off. . | |
| 1549598 | 12/1967 | France . | |
| 1052792 | 3/1959 | Germany . | |
| 2711177 | 8/1978 | Germany . | |
| 75223 | 5/1982 | Japan | 72/12 |

OTHER PUBLICATIONS

International Search Report from European Patent Office dated Nov. 25, 1991.

*Primary Examiner*—David Jones
*Attorney, Agent, or Firm*—Buchanan Ingersoll

[57] ABSTRACT

A machine and method for adjustment of the tooling of a forming machine while continuously operating such machine. The adjusting device being located in a movable or stationary machine part, such as the upper tool part. A measuring device for measuring the cutting and forming result, the measuring signals of which are used to set an actuator which actuates the adjusting device is included. The adjusting device can be actuated by a servo-motor fixed with respect to a stationary machine part. The output shaft of the servo-motor can be coupled with the adjusting device via a transmission arranged on the movable machine part, the driving-sided part of the transmission being arranged on the output shaft of the servo-motor to be slidably displaceable in the direction of movement of the movable machine part and rotatable with the motor output shaft.

20 Claims, 5 Drawing Sheets

6
8
15
11
7
9
5
10
12
4
3
13
17
2
19
18
20

MACHINE WITH AN ADJUSTING DEVICE LOCATED IN A MOVABLE MACHINE PART

This application is a continuation of application Ser. No. 07/741,544, filed Aug. 7, 1991, now abandoned.

FIELD OF INVENTION

The invention relates to a machine of the type having an adjusting device for the cutting and/or forming tool such as used in metal forming operation. The adjusting device being located in a movable machine part, for example the tool upper part, and having a measuring device for measuring the cutting and forming result. The measuring signals are used for setting an actuator which actuates the adjusting device.

BACKGROUND AND PRIOR ART

A cutting and forming machine having provision for manually adjusting the tools and dies on movable portions has been known for a long time. As a rule, one is concerned here with follow-on compound tools in which sheet material is cut and formed in several stages. Such follow-on compound tools essentially comprise a movable as well as a stationary or immovable machine part. Adjusting devices are located in the movable upper part of the tool for setting the cutting and forming assemblies. After the sheet material has left the forming and cutting section, it is led to a measuring device for measuring the cutting and forming results. The measuring signals arising from this serve to set an actuator of the adjusting device. This adjusting process was previously conducted manually and on the basis of the experience of the operator. For this operation the entire machinery must be stopped so that the operator can actuate the adjusting device within the movable portion or the upper part of the tool. The adjustment parts are typically inaccessible while the machine is operating, and risk to personnel often requires complete shut down. As this kind of adjustment involves a trial-and-error process, the steps described above must be carried out several times in order to finally achieve the desired cutting and forming result. However, as the material quality of the sheet material varies not only from coil to coil but also within one coil, such measurements and readjustments must not only be repeated for every change of the sheet material, but often also during the unrolling of the sheet material. This kind of adjustment (typically on the order of magnitude of 0.01 mm) can only be conducted reliably by a trained workman with experience of such a follow-on compound tool and subsequently requires a considerable amount of time in which the follow-on compound tool is not used. The increased costs resulting from this in personnel, training, errors, and machines time lost is considerable. The changes in material within a coil can also not be sufficiently accounted for so that the cutting and forming results within a single coil may not correspond to the desired value, resulting in scrap or unusable product.

SUMMARY OF THE INVENTION

It is therefore an object of the invention to provide a cutting and forming machine of the type initially described in which the adjusting step can be conducted automatically and with as great a precision as possible while the machine is running.

This object is solved in accordance with one embodiment of the invention in that the actuator consists of a servo-motor fixed with respect to a stationary machine part, the output shaft of the servo-motor being coupled to the adjusting device via a transmission arranged on the movable machine part, the part on the driving side of the transmission being arranged on the output shaft of the servo-motor to be non-rotatable but displaceable in the direction of movement of the movable machine part.

By means of such a device, the measuring signals of the measuring device can be fed to a regulating device which processes the measuring signals and controls the servo-motor which automatically actuates the adjusting device. On account of the fact that the part of the transmission on the driving side (input side) is arranged so as to be rotatable with, and slidable on the output shaft of the servo-motor while displaceable on the output shaft in the direction of movement of the movable machine part, a mechanical actuating impulse is transmitted from the fixed servo-motor to the adjusting device which is movable together with the movable machine part, i.e., transmission of a rotational movement to an actuating shaft of the adjusting device which is movable together with the movable machine part is made possible. Such an adjusting step can be conducted fully automatically during the operation of the cutting and forming machine. Thus, trained personnel and down-times of the cutting and forming machine can be avoided for the adjustment. Adjustments to the forming tools can be made as often as after each formed part is measured without the need to stop the machine cycling.

In one presently preferred embodiment, the machine is continuously operated and measurement of the work performed by the tool is measured by a sensor unit at a position following the forming step. The measured values are compared to standards for the specific product, and a mechanical output is generated to adjust the tool when undesired variation occurs between the standard and the measured values.

In a presently preferred embodiment of the invention, the transmission is a worm drive. Advantageously, the driving-sided part of the worm drive is formed as a worm which has a polygonal opening arranged co-axially to its rotational axis in which a corresponding polygonal output shaft of the servo-motor engages. On account of such an arrangement the worm is non-twistably mounted on the motor shaft, and longitudinally displaceable or slidable on the output shaft of the servo-motor so that it can move together with the transmission and the movable machine part. The worm rotates with the motor shaft. The output-sided part of the transmission is a worm gear which is fixedly attached to an actuating shaft and connected via this to the adjusting device.

A further advantageous embodiment provides for that the transmission is a toothed gear-toothed rack transmission of the rack and pinion type.

In a further presently preferred embodiment of the invention, the servo-motor is a stepping motor. The control signals emitting from the regulating device can thus be transformed into a precise rotational or axial movement for actuating the adjusting device.

In a useful development, the adjusting device has a wedge slide longitudinally displaceable and non-rotating on the movable machine part, the wedged surface of which forcibly acts on a tappet movable together with the movable machine part and connected with the cutting and forming tool to transmit movement, the tool being guided in the immovable machine part. In this case, the wedge slide is connected via an adjustable thread or screw connection to the actuating shaft of the transmission.

It is also possible to arrange a wedge slide in the stationary machine part so that its wedged surface acts directly on the cutting or forming tool arranged in the stationary or movable machine part.

During a cutting or bending step, when the tool is arranged in the movable machine part and a cutting or forming force directed downwardly is to be applied on the workpiece, the wedge slide acts directly on the cutting or forming tool which is also arranged in the movable machine part.

An additional preferred embodiment provides for that the transmission formed on the movable machine part is a cardan point the output-sided part of which is secured to an actuating shaft of the adjusting device and the driving-sided part of which is securely connected to a telescopic rod. This telescopic rod is guided in a longitudinally displaceable manner and rotatable together with an output shaft of the servo-motor, which shaft is formed as a telescopic rod, the shaft being connected via a further cardan joint with the servo-motor.

It is also possible to conduct the transmission of the actuating movement from the fixed servo-motor to the adjusting device, which is moved together with the movable machine part, by means of a flexible shaft.

DESCRIPTION OF THE DRAWINGS

A particularly advantageous exemplified embodiment described in the following is shown in the drawings, in which.

DESCRIPTION OF EMBODIMENTS

Figure 1:
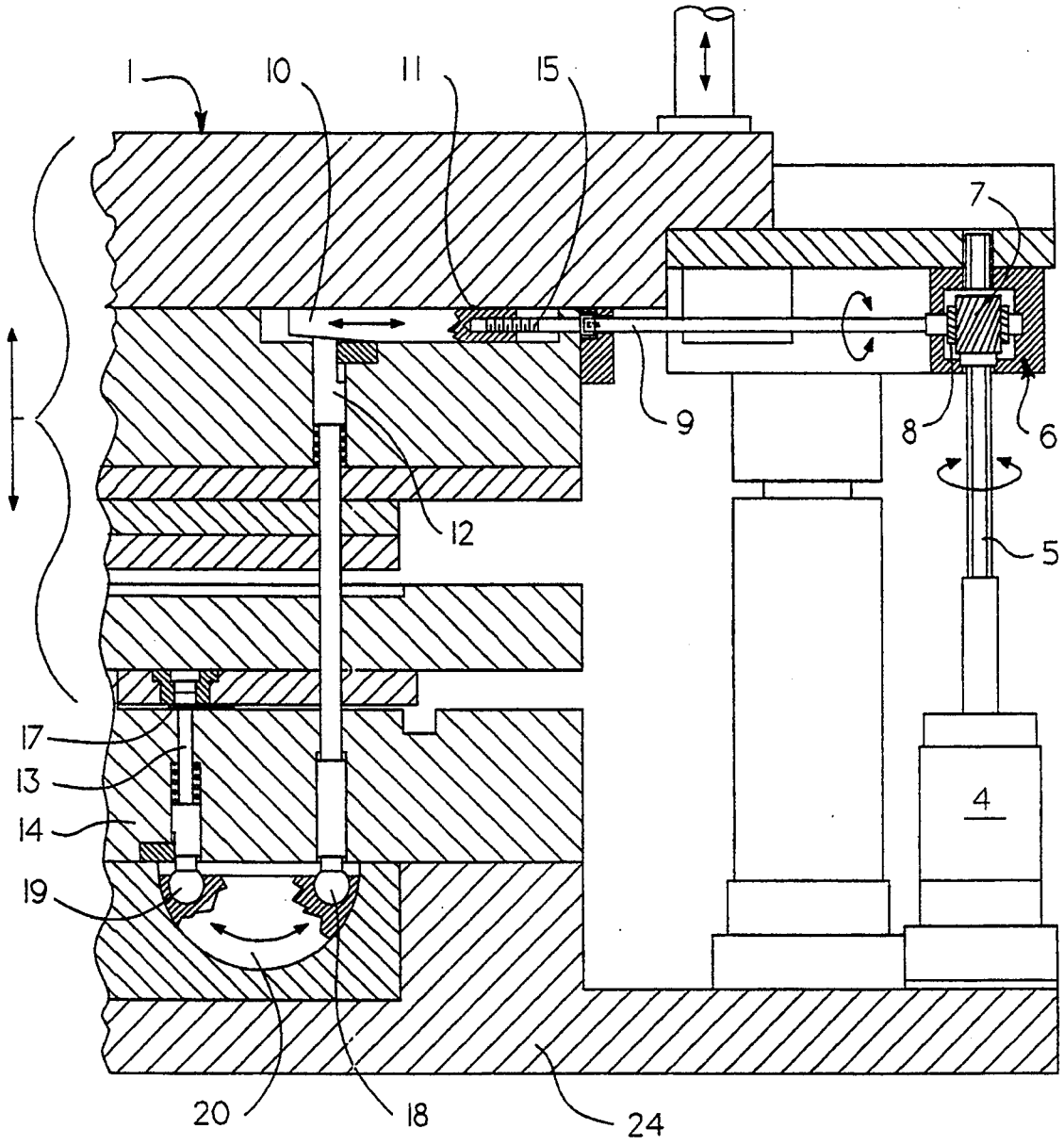
FIG. 1 shows a longitudinal portion in a partial cross-sectional view of a cutting and forming machine according to the invention with a forming tool arranged in the immovable machine part.

In FIG. 1, a depiction of a cutting and forming machine is shown which is formed essentially of a movable machine part having ram 1 as well as an immovable or stationary machine part having a base 24 with a cutting plate 14 attached thereto. In the movable machine part, an adjusting device 11 is provided for feeding the forming tool 13. While FIG. 1 shows a single ram, it is to be understood that multiple rams or movable parts will most commonly be employed on a single machine. Each such movable part may have its own adjusting device and corresponding motor. In addition, additional tooling may be used on a single movable part and multiple adjusting device and motor pairs may be used on a single movable part. In the embodiments described the general movement of the movable part is in the vertical direction as shown in FIG. 1 such as results in metal forming or punching operations. The forming tool 13 processes a sheet material 17 which after leaving the cutting or forming machine, is led through a measuring device 2 for measuring the forming result. The measuring signals are stored in a regulating device 3 and transformed into control signals by means of which a stepping motor 4 is controlled. This stepping motor 4 is securely fixed to the stationary machine part base 24 and has a vertically standing hexagonal driving shaft 5. The upper end of the output shaft 5 engages in a worm 7 of a worm drive 6 which moves together with the movable machine part 1. In this case, the worm 7 comprising a polygonal opening arranged co-axially in its axis of rotation is arranged to be longitudinally displaceable on the hexagonal output shaft 5 of the servo-motor 4. While presently preferred drive arrangements between the motor and transmission use a hexagonal cross-section shaft other polygonal shapes or spline arrangements may also be utilized in practicing the invention.

Additionally, the worm 7 engages with a worm gear 8 which is connected with an actuating shaft 9. The actuating shaft 9 is connected to a spindle 15 fixed along a longitudinal axis, the spindle being threaded into a wedge slide 10 which is non-rotatable and longitudinally displaceable on the movable machine part 1. The inclined plane surface of the wedge slide 10 acts to transmit movement to the upper side of a tappet 12 which is moved together with the movable machine part 1. The lower end of the tappet 12 is supported via a ball-and-socket joint 18 in a rocking system which is rotatably supported as a semi-spherical member in a corresponding semi-spherical recess. A further ball-and-socket joint 19 connects the rocking system 20 with the forming tool 13. In this manner, the bends directed upwardly can be carried out; the downward movement of the tappet by the wedge slide 10 and ram 1 is transferred to upward movement of tool 13.

Figure 3:
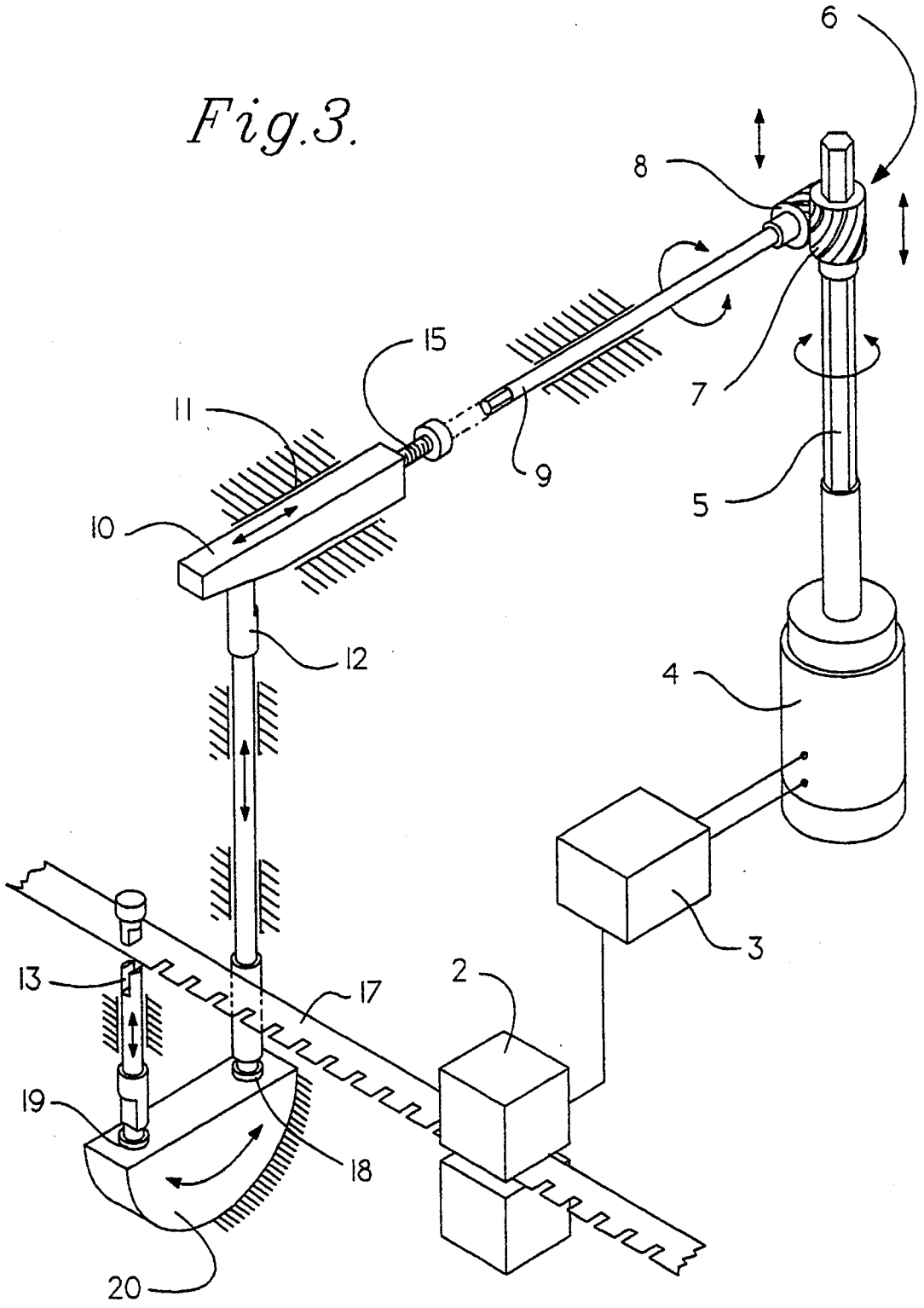
FIG. 3 shows a diagrammatic depiction of a regulating mechanism of the feed of a cutting tool.

Referring to FIG. 3, should the regulating device 3 determine that the measuring signals coming from the measuring device 2 do not correspond to a predetermined desired value, then it actuates the stationary stepping motor 4, from which a mechanical actuating impulse is transmitted via the hexagonal output shaft 5 to the worm drive 6 which is moved together with the movable machine part. The worm gear 8 then actuates the spindle 15 via the actuating shaft 9 in such a manner that a longitudinal displacement of the wedge slide 10 is effected. By means of this, a vertical displacement of the tappet 12 results relative to the movable machine part 1 which is transmitted via the rocking system 20 to the cutting tool 13.

As shown in FIG. 3, a closed loop system can be used to adjust the die mechanism on any given position or station in a given machine. In many preferred embodiments it will be desirable in multi-station presses to utilize a measuring device 2, regulator 3, and servo-motor 4 with related transmission and adjusting devices at each station on a given press.

As shown in FIG. 3 the measuring device 2 is located downstream on the output end of the respective tooling. In practicing the invention, the measuring device senses the actual form produced by the tooling. The regulating device 3 compares the measured value with a predetermined standard value and, if the measured value is outside of the desired range of acceptable parts, causes the servo-motor 4 to actuate in a manner to correct the difference. The regulating device 3 operates in the known fashion of automatic control regulators to provide specific servo outputs for given die applications. As shown in the embodiment in FIG. 3, the measuring device 2 senses the formed part a number of cycles removed downstream from the actual forming operation. In various embodiments the sensing can be by a measuring device done at any point following the specific die station being controlled.

Figure 2:
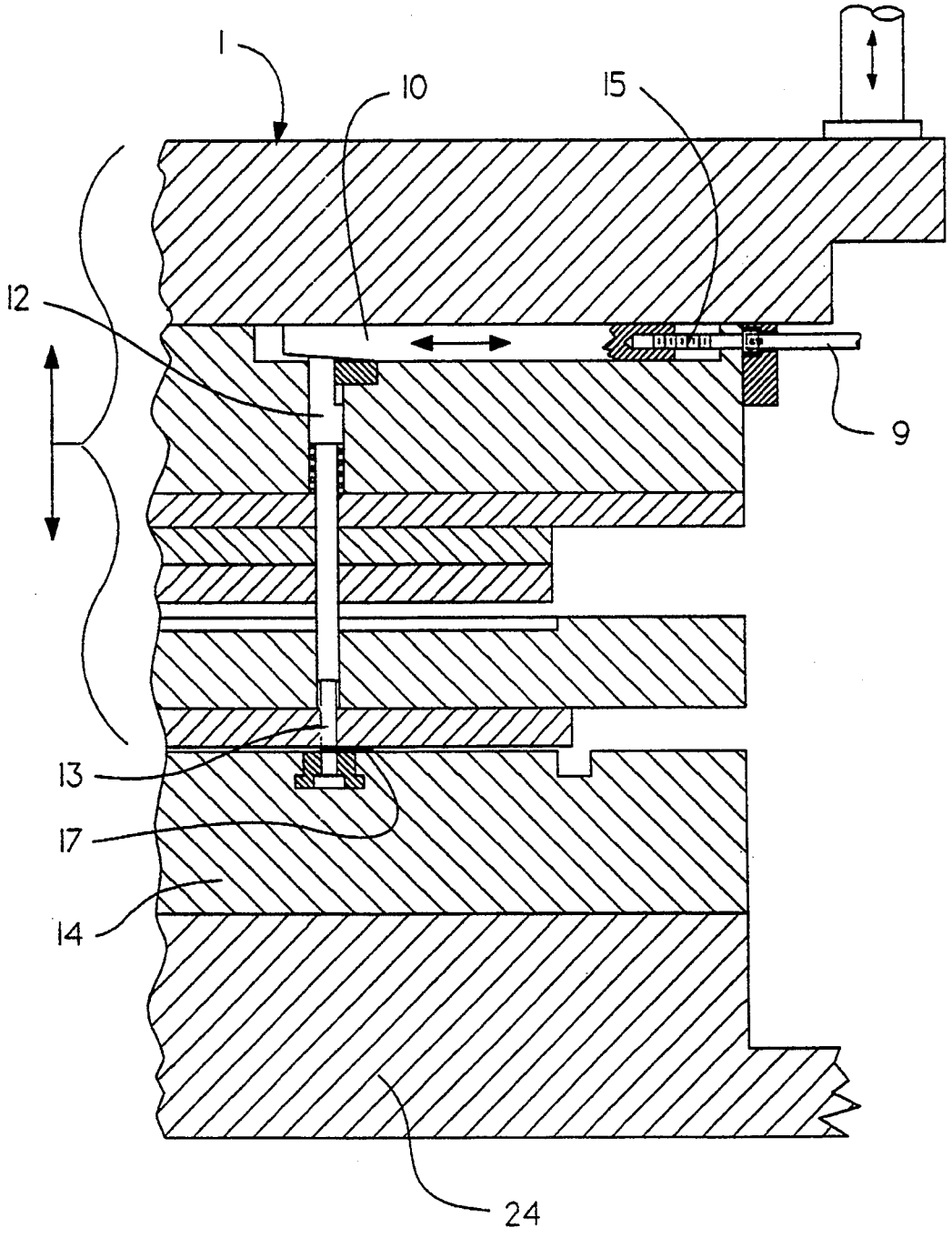
FIG. 2 shows a longitudinal portion in a partial cross-sectional view of a cutting and forming machine according to the invention with a cutting tool arranged in the movable machine part.

FIG. 2 shows a longitudinal cross-section of a partial section of a cutting and forming machine according to an embodiment of the invention having a forming tool 13 arranged in the movable machine part. This forming tool 13 is actuated by tappet 12 to move downwardly onto the sheet material 17, and as a result causes a deformation of the workpiece directed downwardly. After passing the forming station, the workpiece, sheet material 17, is led through a measuring device 2 for measuring the formed result. All further steps follow analogously to the description according to FIG. 1. In this case also, via an actuator and an actuating shaft 9 which is connected with a spindle 15 fixed along a longitudinal axis, a longitudinally displaceable and non-rotating wedge slide 10 on the movable machine part 1 is fed by a rotation of the spindle which is threaded into the wedge slide. In this case, the wedged surface of the wedge slide 10 acts on tappet 12 which directly contacts the forming tool 13 which is moved together with the movable machine part.

While the embodiments shown have indicated that the adjusting means for the die, such as the sliding wedge 10 and the adjusting device 15 can preferably be located on the movable portion of the tool, such adjusting means can in some embodiments be located on the stationary portion and the mechanical output of such adjusting means can then be transmitted to the movable portion. In certain embodiments the stepping motor 4 would cause the adjusting device, such as 11, to be actuated or threadingly moved on the stationary portion, such as cutting plate 14. The corresponding mechanical adjustment would then be transmitted to the movable portion by either rotational means, such as the shaft 5 and transmission 6, or by use of a linear actuator. In embodiments where the die adjusting device is located on the stationary portion, such adjustment can be translated to the movable portion by linear displacements similar to that used by the tappet push rod combination 12. Similarly, where the die to be adjusted is located on the movable portion, angled actuating devices, such as the rocker system 20, can be used to change the direction of linear motion from stationary mounted adjusting devices to the actual die located in the movable portion.

It has been shown that the tooling or die can be adjusted while the machine is operating. In some applications it may be desirable that an actual adjustment to the specific die be accomplished during the non-tool working portion of the machine cycle. This would include the time portions of the cycle in which the die is parting, portions in which the material is moving, and portions of the down stroke prior to die contact with the material. Adjustment during such portions is desirable as the adjusting devices are not required to move during the high force stamping or die working portions of the cycle.

Figure 4:
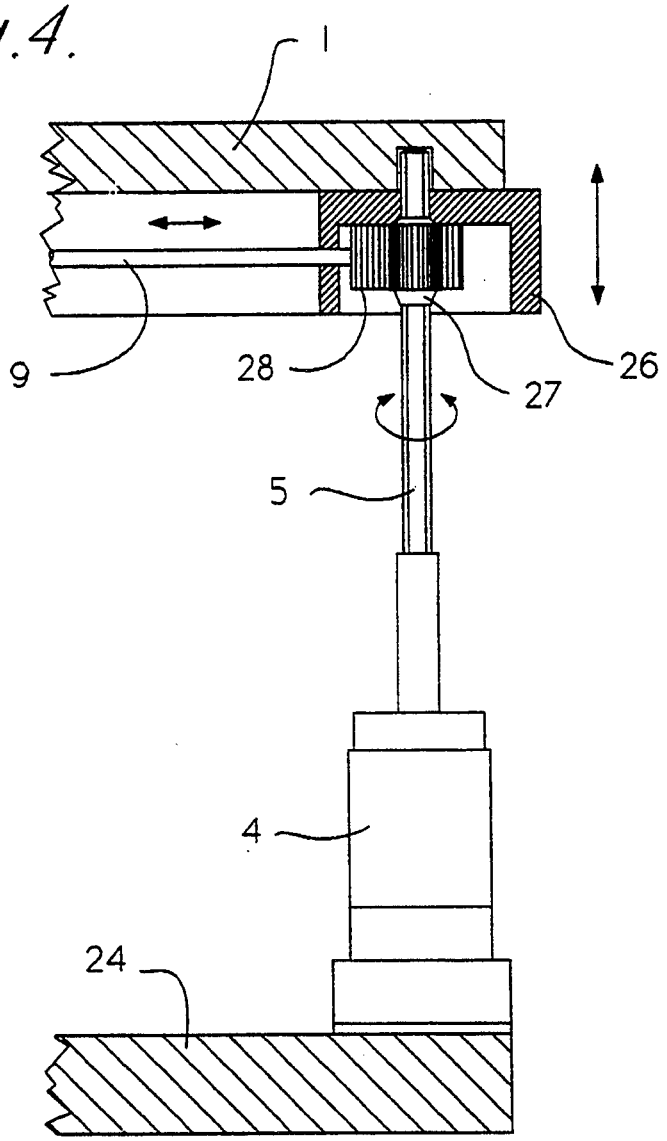
FIG. 4 shows a fragmented diagrammatic representation in partial cross-section of an embodiment having a rack and pinion transmission on the movable machine part.

Referring to FIG. 4 is shown a partial cross-sectional diagram of an embodiment similar to that shown in FIGS. 1, 2 and 3, but using a rack and pinion transmission. The transmission 26 has an input member shown as a pinion gear 27. Pinion gear 27 has a central axial through bore having a slidably mateable surface to the output shaft 5 of motor 4. As shown, the shaft 5 and pinion may use a hexagonal cross-section arrangement such that as movable part 1 is displaced vertically, the pinion 27 will remain fixed with transmission 26 but slidably move axially along shaft 5. This interlocking between pinion 27 and shaft 5 allows rotational movement of the shaft 5 to cause pinion 27 to move toothed rack 28 in a longitudinal direction. Rack 28 is fixably attached to actuator shaft 9 which moves longitudinally to cause a sliding wedge to adjust the tool as previously described.

Figure 6:
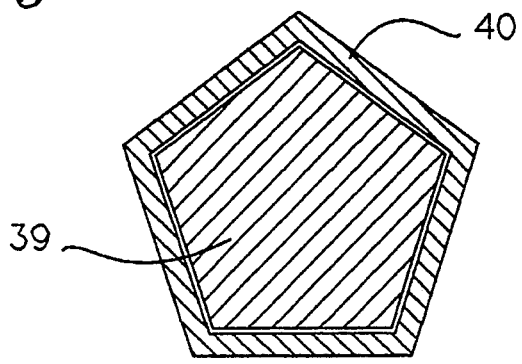
FIG. 6 is a cross-section along section line 6—6 in FIG. 5 of the telescoping shaft.
Figure 5:
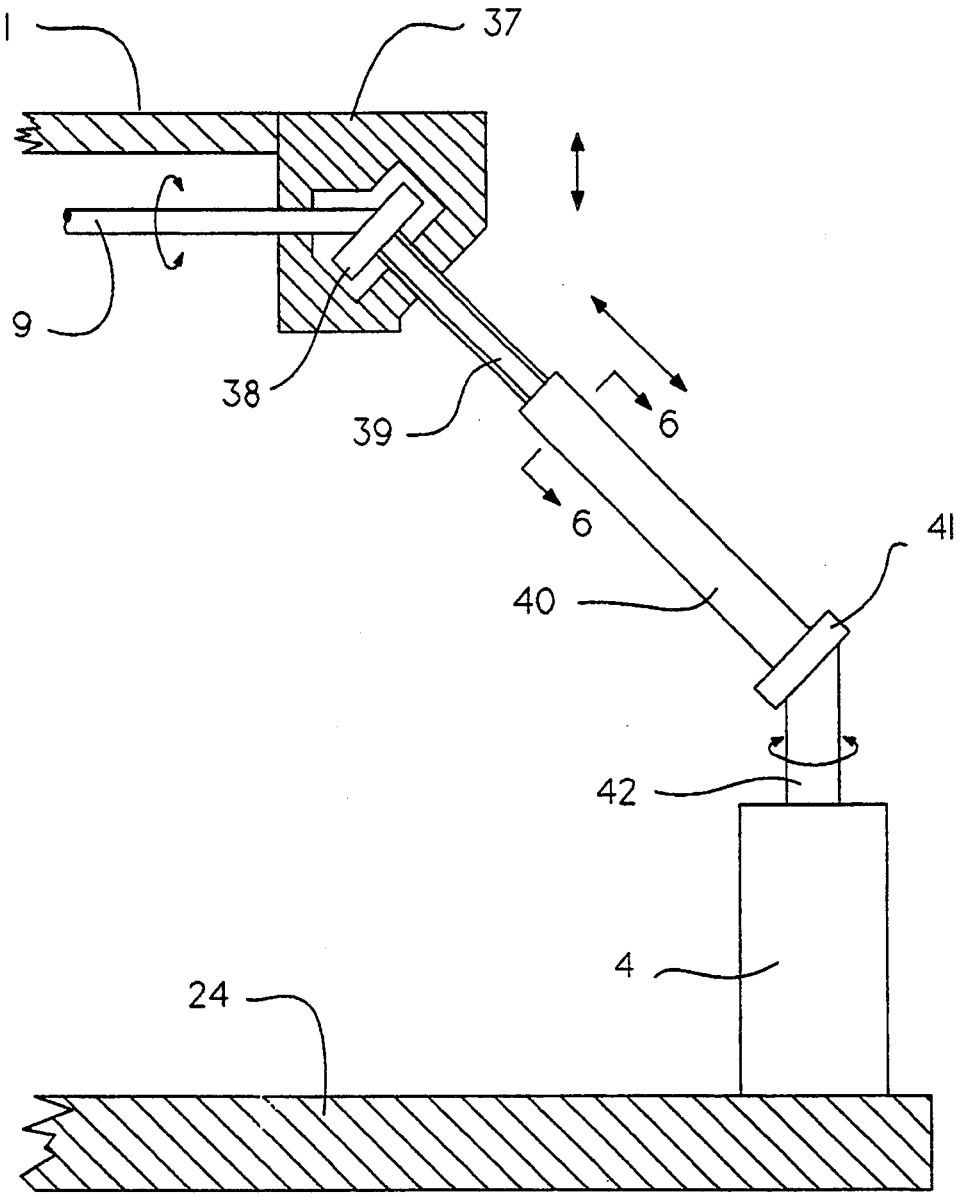
FIG. 5 shows a diagrammatic representation of an embodiment having the transmission fixed to the movable part and connected to the stationary motor by a telescoping shaft and two cardan joints.

Referring to FIG. 5 is shown a diagram of a partial view of another embodiment. In this embodiment transmission 37 transmits rotational movement from the input shaft to the actuator shaft 9. The transmission 37 is driven by motor 4 through a lower cardan or universal type joint 22 to an outer shaft 40. Outer shaft 40 has an inner shaft 39 co-axially fixed to slide axially within the outer shaft. As the movable part 1 moves vertically, the telescoping shaft of inner shaft 39, and outer shaft 40, contracts or expands in its axial extent. Inner shaft 39 is rotatably fixed to outer shaft 40 by having interlocking cross-sectional shapes as shown in FIG. 6. While a pentagon shape is shown in FIG. 6, other polygons or spline shafts may be used. Inner shaft 39 is connected to an upper cardan joint 38 which is part of transmission 37. The use of the telescoping shaft permits the adjusting device to be mounted on the movable part while the drive motor that controls the adjustment is located on the stationary part of the machine. The use of upper and lower cardan joints permits axial displacement and multi-angular positioning of the motor relative to the movable part.

By means of the device described above, an adjusting step of a cutting and forming tool of a cutting and forming machine, the adjusting device of which is located in a movable machine part, can be conducted automatically and while the machine is running with great precision. Advantageously, a measuring device is provided behind every cutting or forming station of the cutting and forming machine. Thus, unsatisfactory cutting and forming results on account of material discrepancies within a coil of the sheet material can also be continuously corrected.

We claim:

1. An improved cutting and forming machine having a stationary machine part and a movable machine part, such cutting and forming machine having a tool which is attached to such movable machine part and is movable to form pieces from a sheet in repetitive machine cycles, such movable machine part being movable in a direction of movement toward such stationary machine part during such repetitive machine cycles, such movable machine part having an adjusting device for adjusting such tool, such adjusting device being located in such movable machine part that is moved during such machine cycles, such cutting and forming machine having a measuring device located at a position following .an operation of such tool for measuring the results of such operation of such tool, such forming and cutting machine having an actuator attached to such stationary machine part for actuating such adjusting device, such measuring device connected to such actuator and generating measuring signals, which are used for setting such actuator, which actuates such adjusting device wherein the improvement comprises:

such actuator having a servo-motor fixed with respect to such stationary machine part;

said servo-motor having an output shaft, said output shaft of said servo-motor being coupled to a transmission, said transmission having an input side part coupled to said output shaft of said servo-motor, said transmission having an output side part coupled to said adjusting device, and said transmission arranged on such movable machine part; and said transmission having an input side part arranged on said output shaft of said servo-motor to be displaceable in such direction of movement of such movable machine part and rotatable together with said output shaft of said servo-motor.

2. The cutting and forming machine according to claim 1 further comprising said transmission having a worm drive having an input side connected to said output shaft of said servo-motor and an output side connected to such adjusting device.

3. The cutting and forming machine according to claim 1 wherein said transmission has a toothed gear and a toothed rack, said toothed gear connected to said output shaft of said servo-motor, said toothed rack connected to such adjusting device, and said toothed gear in mesh with said toothed rack.

4. The cutting and forming machine according to claim 2 wherein said input side part of said worm drive is a worm having a polygonal bore arranged co-axially to the axis of rotation of said worm, said output shaft of said servo-motor is an output shaft having a polygonal shaped portion over which said polygonal bore of said worm is engaged, said output side part of said worm drive is a worm gear which is connected to an actuating shaft, and said actuating shaft is connected to such adjusting device.

5. The cutting and forming machine according to claim 1 wherein said servo-motor is a stepping motor.

6. The cutting and forming machine according to claim 1 further comprising:

such adjusting device having a wedge slide which is non-rotatable and longitudinally displaceable on such movable machine part;

a tappet in spaced relationship with said wedge slide for transmitting movement from said wedge slide to such tool;

said wedge slide having a wedged surface by which said wedged surface may act on said tappet so that said tappet is moved together with such movable machine part and connected with such tool to transmit thereto movement;

an actuating shaft coupled to said transmission for transmitting movement to said wedge slide;

such stationary machine part having a guide, so that movement of such tool may be restrained; and a threaded connection integral with said wedge slide for coupling said wedge slide to said actuating shaft of said transmission.

7. The cutting and forming machine according to claim 1 further comprising:

such adjusting device having a wedge slide which is non-rotatable and longitudinally displaceable on such movable machine part;

said wedge slide having a wedge surface which acts on such tool, which is moved together with such movable machine part; and said wedge slide having a threaded connection so that said wedge slide is connected with said transmission.

8. The cutting and forming machine according to claim 1 further comprising:

such forming and cutting machine having a plurality of such tools having a respective plurality of such actuators associated with corresponding ones of said plurality of such tools and;

a plurality of such measuring devices for measuring the results of each of said operations of each of such plurality of such tools, each of such measuring devices electrically connected to said respective plurality of such actuators and generating such measuring signals which are conveyed to the respective ones of said respective plurality of such actuators associated with the corresponding one of said tools.

9. The cutting and forming machine according to claim 1 further comprising:

said transmission arranged on said movable machine part having a first cardan joint interposed between said input side part of said transmission and said output side part of said transmission;

said output side part of said transmission being connected to an actuating shaft, said actuating shaft also being connected to such adjusting device;

said input side part of said transmission being connected to a telescopic rod, said telescopic rod being restrained by a guide to be non-twistable and longitudinally displaceable with said output shaft of said servo-motor; and said servo-motor being connected to said output shaft of said servo-motor by a second cardan joint, said output shaft of said servo-motor being formed with a telescopic portion.

10. An improvement in a machine having a tool for forming products from a metal sheet in a continuous operation of repetitive machine cycles, such machine having a stationary part and a movable part, such movable part containing such tool and being movable in a direction of relative movement between such stationary part and such movable part, the improvement comprising:

measuring means operably connected to such machine for sensing at least one predetermined dimension of such product following such forming by such tool and for comparing a measured value with a standard value for such product;.

adjusting means mounted on such movable part for adjusting the extent of movement of such tool during the continuous operation of such machine; and actuation means, operably connected to such machine, said actuation means] for actuating said adjusting means during the continuous operation of such machine when said measured values vary from said standard values, said actuation means being operably connected with said measuring means and such machine, said actuation means being at least partially mounted on such stationary part, and said actuation means including means for generating a mechanical movement to actuate said adjusting means.

11. The improvement of claim 10 wherein said mechanical movement is transmitted from such stationary part to such movable part.

12. The improvement of claim 11 wherein said actuation means includes a telescoping driveshaft device for permitting slidable movement generally in such direction of the relative movement between such stationary part and such movable part.

13. The improvement of claim 11 wherein said adjusting means includes a movable wedge having an inclined plane portion for slidably engaging of such tool.

14. The improvement of claim 10 wherein at least a portion of said adjusting means is mounted on such stationary part.

15. The improvement of claim 10 wherein said adjusting means includes means for adjusting such tool during a non-tool working part of such cycle of such machine.

16. The improvement of claim 10 wherein said adjusting means includes a movable wedge having an inclined portion for slidably adjusting such tool in response to a mechanical movement generated on such stationary part.

17. The improvement of claim 16 wherein said movable wedge is moved through engagement with a threaded member on said movable part rotating from said mechanical movement.

18. The improvement of claim 16 wherein said adjusting means adjusts such tool during a non-tool working portion of such cycle of such machine when such machine is continuously operating.

19. The improvement of claim 10 wherein said adjusting means adjusts such tooling during a non-tool working portion of a cycle when such machine is continuously operating.

20. The improvement of claim 10 wherein said adjusting means adjusts such tool during a non-tool working portion of such cycle of such machine when such machine is continuously operating.

* * * * *

UNITED STATES PATENT AND TRADEMARK OFFICE

CERTIFICATE OF CORRECTION

PATENT NO. : 5,381,681

DATED : January 17, 1995

INVENTOR(S) : Helmuth Frisch, Norbert Geissler, Herbert Weiss

It is certified that error appears in the above-indentified patent and that said Letters Patent is hereby corrected as shown below:

Column 7, line 54, claim 6, after "said" insert --output side of said--.

Signed and Sealed this

Second Day of May, 1995

*Attest:*

Bruce Lehman

BRUCE LEHMAN

*Attesting Officer*

*Commissioner of Patents and Trademarks*